US008695716B2

(12) United States Patent
Ravensbergen

(10) Patent No.: US 8,695,716 B2
(45) Date of Patent: Apr. 15, 2014

(54) MULTI-ZONE FRACTURING COMPLETION

(75) Inventor: John Edward Ravensbergen, DeWinton (CA)

(73) Assignee: Baker Hughes Incorporated, Houston, TX (US)

( * ) Notice: Subject to any disclaimer, the term of this patent is extended or adjusted under 35 U.S.C. 154(b) by 94 days.

(21) Appl. No.: 12/971,932

(22) Filed: Dec. 17, 2010

(65) Prior Publication Data

US 2011/0308817 A1 Dec. 22, 2011

Related U.S. Application Data

(63) Continuation-in-part of application No. 12/842,099, filed on Jul. 23, 2010, now Pat. No. 8,613,321.

(60) Provisional application No. 61/228,793, filed on Jul. 27, 2009.

(51) Int. Cl.
*E21B 23/00* (2006.01)
*E21B 34/00* (2006.01)

(52) U.S. Cl.
USPC ..... 166/381; 166/319

(58) Field of Classification Search
USPC ..... 166/120, 382, 147, 305.1, 205, 373, 166/381, 386, 316, 319
See application file for complete search history.

(56) References Cited

U.S. PATENT DOCUMENTS 2,187,483 A 1/1940 Baker
2,189,702 A 2/1940 Burt
2,307,662 A * 1/1943 Baylor ..... 166/67
4,088,191 A 5/1978 Hutchison
4,257,484 A 3/1981 Whitley
4,260,017 A 4/1981 Nelson
4,312,406 A 1/1982 McLaurin et al.
4,330,039 A * 5/1982 Vann et al. ..... 166/297
4,429,747 A 2/1984 Williamson (Continued)

FOREIGN PATENT DOCUMENTS

CA 2210103 A1 5/1998
CA 2322075 A1 4/2001

(Continued)

OTHER PUBLICATIONS

Baker Hughes Catalog Flow Control Systems dated 2002, pp. 58 and 61.

(Continued)

*Primary Examiner* — Giovanna Wright
*Assistant Examiner* — Michael Wills, III
(74) *Attorney, Agent, or Firm* — Parsons Behle & Latimer

(57) ABSTRACT

A ported housing that may be connected along a casing string and the method for use of the ported housing in fracturing and/or treating multiple zones in a well. A sleeve is connected to the ported housing and may be moved between an initial position that prevents fluid flow through the ports of the housing and second position that permits fluid flow through the ports. A bottom hole assembly may be connected to the sleeve by an anchor. A packer element may create a seal between the bottom hole assembly and the sleeve permitting a pressure differential across the packer element to move bottom hole assembly down the casing moving the sleeve to the second position. In the second position, the formation adjacent to the ported housing may be stimulated and/or treated.

20 Claims, 8 Drawing Sheets

(56) References Cited

U.S. PATENT DOCUMENTS

| | | | | |
|---|---|---|---|---|
| 5,358,048 | A | 10/1994 | Brooks et al. | |
| 5,417,291 | A * | 5/1995 | Leising | 175/320 |
| 5,443,124 | A | 8/1995 | Wood et al. | |
| 5,513,703 | A * | 5/1996 | Mills et al. | 166/55.1 |
| 6,024,173 | A | 2/2000 | Patel et al. | |
| 6,513,595 | B1 | 2/2003 | Freiheit | |
| 6,832,654 | B2 | 12/2004 | Ravensbergen et al. | |
| 6,883,610 | B2 | 4/2005 | Depiak | |
| 7,066,264 | B2 * | 6/2006 | Bissonnette et al. | 166/305.1 |
| 7,124,824 | B2 * | 10/2006 | Turner et al. | 166/374 |
| 7,249,633 | B2 * | 7/2007 | Ravensbergen et al. | 166/301 |
| 7,387,165 | B2 | 6/2008 | Lopez de Cardenas et al. | |
| 7,556,102 | B2 | 7/2009 | Gomez | |
| 7,748,463 | B2 | 7/2010 | Revheim | |
| 7,789,163 | B2 * | 9/2010 | Kratochvil et al. | 166/387 |
| 7,810,570 | B2 | 10/2010 | Collins et al. | |
| 7,823,633 | B2 * | 11/2010 | Hartwell | 166/66.6 |
| 7,861,774 | B2 * | 1/2011 | Fehr et al. | 166/191 |
| 7,861,788 | B2 | 1/2011 | Tips et al. | |
| 2003/0019628 | A1 | 1/2003 | Ravensbergen | |
| 2003/0127227 | A1 | 7/2003 | Fehr | |
| 2004/0238173 | A1 * | 12/2004 | Bissonnette et al. | 166/307 |
| 2005/0000693 | A1 | 1/2005 | Ravensbergen | |
| 2005/0072577 | A1 | 4/2005 | Freeman | |
| 2005/0126787 | A1 * | 6/2005 | Gomez | 166/319 |
| 2006/0000620 | A1 | 1/2006 | Hamilton | |
| 2006/0124310 | A1 | 6/2006 | Lopez de Cardenas | |
| 2006/0231253 | A1 * | 10/2006 | Vilela et al. | 166/278 |
| 2006/0243435 | A1 | 11/2006 | Faul | |
| 2007/0272411 | A1 | 11/2007 | Lopez de Cardenas | |
| 2008/0210431 | A1 * | 9/2008 | Johnson et al. | 166/330 |
| 2009/0014168 | A1 | 1/2009 | Tips et al. | |
| 2009/0044944 | A1 | 2/2009 | Murray et al. | |
| 2009/0084553 | A1 * | 4/2009 | Rytlewski et al. | 166/305.1 |
| 2010/0089587 | A1 | 4/2010 | Stout | |
| 2010/0263873 | A1 | 10/2010 | Turner et al. | |
| 2011/0155377 | A1 | 6/2011 | Laun | |
| 2011/0308817 | A1 | 12/2011 | Ravensbergen | |
| 2012/0111566 | A1 * | 5/2012 | Sherman et al. | 166/297 |

FOREIGN PATENT DOCUMENTS

| | | | |
|---|---|---|---|
| CA | 2385795 | A1 | 4/2001 |
| CA | 2397460 | A1 | 8/2001 |
| CA | 2375045 | A1 | 9/2002 |
| CA | 2381620 | A1 | 10/2002 |
| CA | 2392277 | A1 | 12/2002 |
| CA | 2535940 | A1 | 8/2006 |
| CA | 2623100 | A1 | 3/2007 |
| CA | 2559815 | A1 | 9/2007 |
| CA | 2622044 | | 9/2008 |
| CA | 2641778 | | 4/2010 |
| CA | 2688106 | A1 | 7/2010 |
| CA | 2693676 | | 7/2010 |
| CA | 2670218 | | 12/2010 |
| CA | 2711329 | | 1/2011 |
| CA | 2738907 | | 7/2011 |
| EP | 0581533 | A2 | 2/1994 |
| WO | WO2004063527 | A1 | 7/2004 |
| WO | WO2007075855 | | 7/2007 |
| WO | WO2008091345 | A1 | 7/2008 |

OTHER PUBLICATIONS

Office Action issued in corresponding Canadian Patent Application No. 2,711,329, dated Mar. 17, 2011.
International Search Report dated Apr. 4, 2013 issued in PCT/US2011/065212.
International Search Report dated Apr. 11, 2013 issued in PCT/US2012/051679.
Office Action issued in U.S. Appl. No. 12/842,099 dated Mar. 14, 2013.
Office Action dated Feb. 21, 2013, issued in Canadian Patent Application No. 2,781,721.
Protest and Prior Art Submission dated Mar. 5, 2013, filed in Canadian Patent Application No. 2,730,695.
Office Action dated Nov. 1, 2012 issued in Canadian Patent Application No. 2711329.
Office Action dated Dec. 19, 2012, issued in Canadian Patent application No. 2,746,522.
Office Action dated Jan. 30, 2013 issued in Canadian Patent Application No. 2730695.
Office Action issued in Canadian Patent Application No. 2711329 dated Sep. 6, 2011.
Office Action issued in Canadian Patent Application No. 2711329 dated Mar. 19, 2012.
Protest filed in Canadian Patent Application No. 2711329 dated Feb. 10, 2012.
Office Action issued in Canadian Patent Application No. 2730695 dated Apr. 5, 2012.
Office Action issued in Canadian Patent Application No. 2730695 dated Apr. 27, 2011.
Notice of Protest issued in Canadian Patent Application No. 2730695 dated Feb. 24, 2012.
Protest filed Under S 34.1 in Canadian Patent Application No. 2730695 dated Feb. 23, 2012.
Protest and Prior Art Submission in Canadian Patent Application No. 2730695 filed on Aug. 16, 2012.
Notice of Protest filed in Canadian Patent Application No. 2730695 dated Aug. 24, 2012.
Notice of Protest filed in Canadian Patent Application No. 2711329 dated Feb. 13, 2012.
Office Action issued in Canadian Patent Application No. 2711329 dated Jun. 29, 2012.
Office Action issued in Canadian Patent Application No. 2781721 dated Sep. 25, 2012.
Canadian Office Action dated Sep. 13, 2013 issued in CA 2746522.
Office Action dated Apr. 26, 2013, issued in Canadian Patent Application No. 2,797,934.
Office Action dated Aug. 27, 2013, issued in Canadian Patent Application No. 2,730,695.

* cited by examiner

MULTI-ZONE FRACTURING COMPLETION

RELATED APPLICATIONS

The present disclosure is a continuation-in-part application of U.S. patent application Ser. No. 12/842,099 entitled "BOTTOM HOLE ASSEMBLY WITH PORTED COMPLETION AND METHODS OF FRACTURING THEREWITH" by John Edward Ravensbergen and Lyle Laun filed on Jul. 23, 2010, which claims the benefit of U.S. Provisional Patent Application No. 61/228,793 entitled "BOTTOM HOLE ASSEMBLY WITH PORTED COMPLETION AND METHODS OF FRACTURING THEREWITH" by John Edward Ravensbergen filed on Jul. 27, 2009, each of which are hereby incorporated by reference in its entirety.

BACKGROUND

1. Field of the Disclosure

The present disclosure relates generally to a downhole tool for use in oil and gas wells, and more specifically, to a ported completion that can be employed for fracturing in multi-zone wells.

2. Description of the Related Art

Oil and gas well completions are commonly performed after drilling hydrocarbon producing wellholes. Part of the completion process includes running a well casing assembly into the well. The casing assembly can include multiple lengths of tubular casing attached together by collars. A standard collar can be, for example, a relatively short tubular or ring structure with female threads at either end for attaching to male threaded ends of the lengths of casing. The well casing assembly can be set in the wellhole by various techniques. One such technique includes filling the annular space between the wellhole and the outer diameter of the casing with cement.

After the casing is set in the well hole, perforating and fracturing operations can be carried out. Generally, perforating involves forming openings through the well casing and into the formation by commonly known devices such as a perforating gun or a sand jet perforator. Thereafter, the perforated zone may be hydraulically isolated and fracturing operations are performed to increase the size of the initially-formed openings in the formation. Proppant materials are introduced into the enlarged openings in an effort to prevent the openings from closing.

More recently, techniques have been developed whereby perforating and fracturing operations are performed with a coiled tubing string. One such technique is known as the Annular Coil Tubing Fracturing Process, or the ACT-Frac Process for short, disclosed in U.S. Pat. Nos. 6,474,419, 6,394,184, 6,957,701, and 6,520,255, each of which is hereby incorporated by reference in its entirety. To practice the techniques described in the aforementioned patents, the work string, which includes a bottom hole assembly (BHA), generally remains in the well bore during the fracturing operation (s).

One method of perforating, known as the sand jet perforating procedure, involves using a sand slurry to blast holes through the casing, the cement and into the well formation. Then fracturing can occur through the holes. One of the issues with sand jet perforating is that sand from the perforating process can be left in the well bore annulus and can potentially interfere with the fracturing process. Therefore, in some cases it may be desirable to clean the sand out of the well bore, which can be a lengthy process taking one or more hours per production zone in the well. Another issue with sand jet perforating is that more fluid is consumed to cut the perforations and either circulate the excess solid from the well or pump the sand jet perforating fluid and sand into the zone ahead of and during the fracture treatment. Demand in industry is going toward more and more zones in multi-zone wells, and some horizontal type wells may have 40 zones or more. Cleaning the sand from such a large number of zones can add significant processing time, require the excessive use of fluids, and increase the cost. The excessive use of fluids may also create environmental concerns. For example, the process requires more trucking, tankage, and heating and additionally, these same requirements are necessary when the fluid is recovered from the well.

Well completion techniques that do not involve perforating are known in the art. One such technique is known as packers-plus-style completion. Instead of cementing the completion in, this technique involves running open hole packers into the well hole to set the casing assembly. The casing assembly includes ported collars with sleeves. After the casing is set in the well, the ports can be opened by operating the sliding sleeves. Fracturing can then be performed through the ports.

For multi-zone wells, multiple ported collars in combination with sliding sleeve assemblies have been employed. The sliding sleeves are installed on the inner diameter of the casing and/or sleeves and can be held in place by shear pins. In some designs, the bottom most sleeve is capable of being opened hydraulically by applying a differential pressure to the sleeve assembly. After the casing with ported collars is installed, a fracturing process is performed on the bottom most zone of the well. This process may include hydraulically sliding sleeves in the first zone to open ports and then pumping the fracturing fluid into the formation through the open ports of the first zone. After fracturing the first zone, a ball is dropped down the well. The ball hits the next sleeve up from the first fractured zone in the well and thereby opens ports for fracturing the second zone. After fracturing the second zone, a second ball, which is slightly larger than the first ball, is dropped to open the ports for fracturing the third zone. This process is repeated using incrementally larger balls to open the ports in each consecutively higher zone in the well until all the zones have been fractured. However, because the well diameter is limited in size and the ball sizes are typically increased in quarter inch increments, this process is limited to fracturing only about 11 or 12 zones in a well before ball sizes run out. In addition, the use of the sliding sleeve assemblies and the packers to set the well casing in this method can be costly. Further, the sliding sleeve assemblies and balls can significantly reduce the inner diameter of the casing, which is often undesirable. After the fracture stimulation treatment is complete, it is often necessary to mill out the balls and ball seats from the casing.

Another method that has been employed in open-hole wells (that use packers to fix the casing in the well) is similar to the packers-plus-style completion described above, except that instead of dropping balls to open ports, the sleeves of the subassemblies are configured to be opened mechanically. For example, a shifting tool can be employed to open and close the sleeves for fracturing and/or other desired purposes. As in the case of the packers-plus-style completion, the sliding sleeve assemblies and the packers to set the well casing in this method can be costly. Further, the sliding sleeve assemblies can undesirably reduce the inner diameter of the casing. In addition, the sleeves are prone to failure due to high velocity sand slurry erosion and/or sand interfering with the mechanisms.

Another technique for fracturing wells without perforating is disclosed in co-pending U.S. patent application Ser. No.

12/826,372 entitled "JOINT OR COUPLING DEVICE INCORPORATING A MECHANICALLY-INDUCED WEAK POINT AND METHOD OF USE," filed Jun. 29, 2010, by Lyle E. Laun, which is incorporated by reference herein in its entirety.

The present disclosure is directed to overcoming, or at least reducing the effects of, one or more of the issues set forth above.

SUMMARY OF THE DISCLOSURE

The following presents a summary of the disclosure in order to provide an understanding of some aspects disclosed herein. This summary is not an exhaustive overview, and it is not intended to identify key or critical elements of the disclosure or to delineate the scope of the invention as set forth in the appended claims.

One embodiment of the present disclosure is a wellbore completion system that includes a housing operatively connected to a casing string. The housing includes at least one port through the housing and a sleeve connected to the housing that may be moved between an open position and a closed position. In the closed position, the sleeve prevents fluid communication through the port of the housing. The system includes a bottom hole assembly that has a packing element and an anchor. The anchor is adapted to selectively connected the bottom hole assembly to the sleeve. The packing element is adapted to provide a seal between the bottom hole assembly and the sleeve.

The wellbore completion system may also include a shearable device that is adapted to selectively retain the sleeve in an initial closed position and release the sleeve upon the application of a predetermined amount of force. The system may include an expandable device that is adapted to selectively retain the sleeve in the open position after it has been released and moved from the closed position. The expandable device may be adapted to engage a recess in the housing. The bottom hole assembly is connected to coiled tubing, which may be used to position the bottom hole assembly adjacent to the ported housing. The bottom hole assembly may include a collar casing locator. The anchor and packing element of the bottom hole assembly may be pressure actuated. The wellbore completion system may include a plurality of ported housings along a casing string each including a sleeve movable between a closed position and an open position.

One embodiment of the present disclosure is a method for treating or stimulating a well formation. The method includes positioning a bottom hole assembly within a portion of a casing string adjacent to a first sleeve operatively connected to the casing string. The sleeve is movable between a first position that prevents fluid communication through a first port in the casing string and a second position that permits fluid communication through the first port in the casing string. The method includes connecting a portion of the bottom hole assembly to the first sleeve and moving the bottom hole assembly to move the first sleeve from the first, or closed, position to the second, or open, position.

The method may include treating the well formation adjacent to the first port in the casing string. The method may further include disconnecting the bottom hole assembly from the first sleeve and position the bottom hole assembly adjacent a second sleeve operatively connected to the casing string. The second sleeve being movable between a first position that prevents fluid communication through a second port in the casing string to a second position that permits fluid communication through the second port. The method may include connected a portion of the bottom hole assembly to the second sleeve and moving the bottom hole assembly to move the second sleeve from the closed position to the open position. The method may include treating the well formation adjacent to the second port.

Connecting a portion of the bottom hole assembly to the sleeve may include activating an anchor to engage a portion of the sleeve. The method may include creating a seal between the bottom hole assembly and the sleeve. The method may include selectively releasing the sleeve from its first position prior to moving the bottom hole assembly to move the sleeve. Selectively the sleeve may comprise shearing a shearable device, which may be sheared by increasing pressure within the casing string above the bottom hole assembly, moving the coiled tubing down the casing string, or a combination of increasing the pressure and moving the coiled tubing. The method may include selectively retaining the sleeve in the open position. Positioning the bottom hole assembly and connecting the bottom hole assembly to the sleeve may comprises moving the coiled tubing in only an upward direction. The method may include pumping fluid down the coiled tubing to actuate an anchor of the bottom hole assembly.

Figure 1:
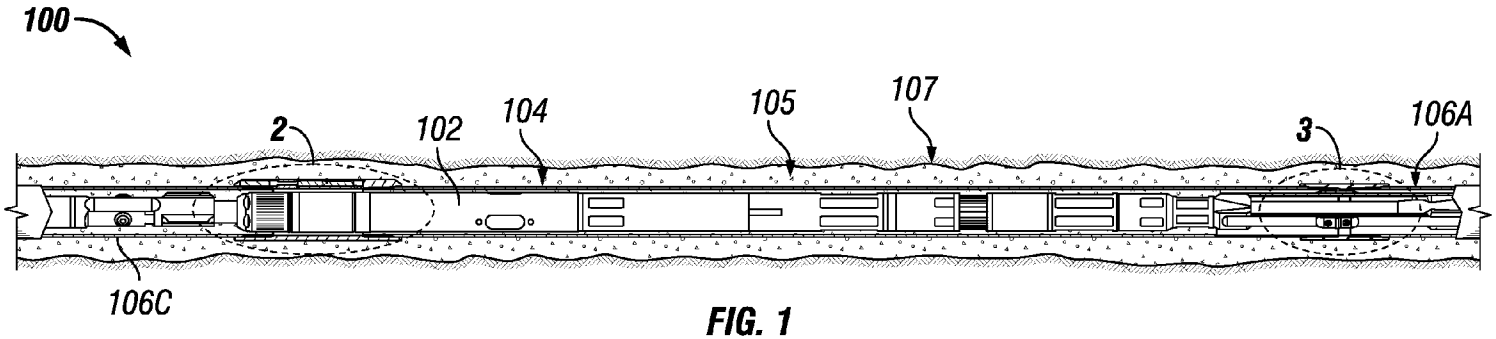
FIG. 1 illustrates a portion of a cemented wellbore completion, according to an embodiment of the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

FIG. 1 illustrates a portion of a wellbore completion 100, according to an embodiment of the present disclosure. Wellbore completion 100 includes a bottom hole assembly ("BHA") 102 inside a casing 104. Any suitable BHA can be employed. In an embodiment, the BHA 102 can be designed for carrying out fracturing in a multi-zone well. An example of a suitable BHA is disclosed in copending U.S. patent application Ser. No. 12/626,006, filed Nov. 25, 2009, in the name of John Edward Ravensbergen and entitled, COILED TUBING BOTTOM HOLE ASSEMBLY WITH PACKER AND ANCHOR ASSEMBLY, the disclosure of which is hereby incorporated by reference in its entirety.

Figure 2:
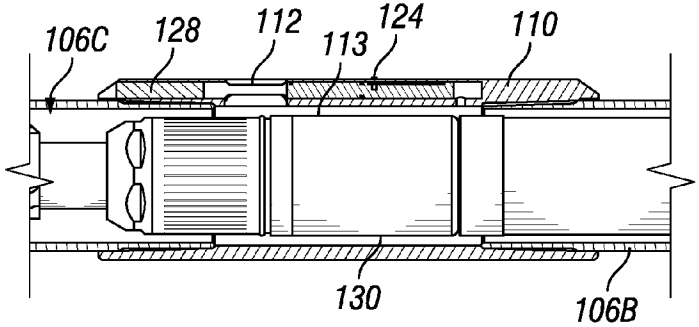
FIG. 2 illustrates a close up view of a collar and bottom hole assembly used in the wellbore completion of FIG. 1, according to an embodiment of the present disclosure.
Figure 3:
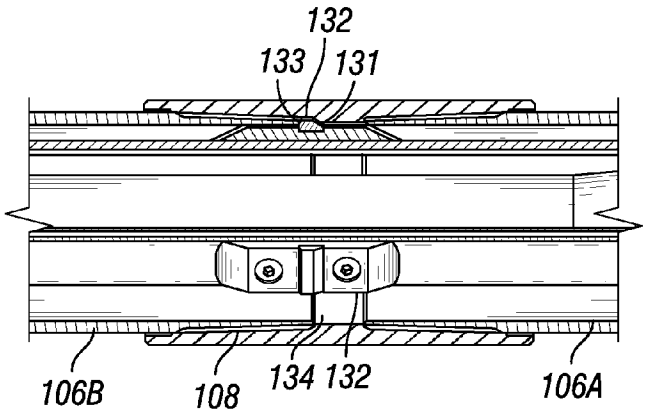
FIG. 3 illustrates a close up view of a locking dog used in the wellbore completion of FIG. 1, according to an embodiment of the present disclosure.

As more clearly illustrated in FIGS. 2 and 3, casing 104 can include multiple casing lengths 106A, 106B and 106C that can be connected by one or more collars, such as collars 108 and 110. Casing lengths 106A, 106B, and/or 106C may be pup joints, segments of casing approximately six (6) feet in length, which may be configured to aid in properly locating a BHA within a desired zone of the wellbore. Collar 108 can be any suitable collar. Examples of collars for connecting casing lengths are well known in the art. In an embodiment, collar 108 can include two female threaded portions for connecting to threaded male ends of the casing lengths 106.

Figure 4:
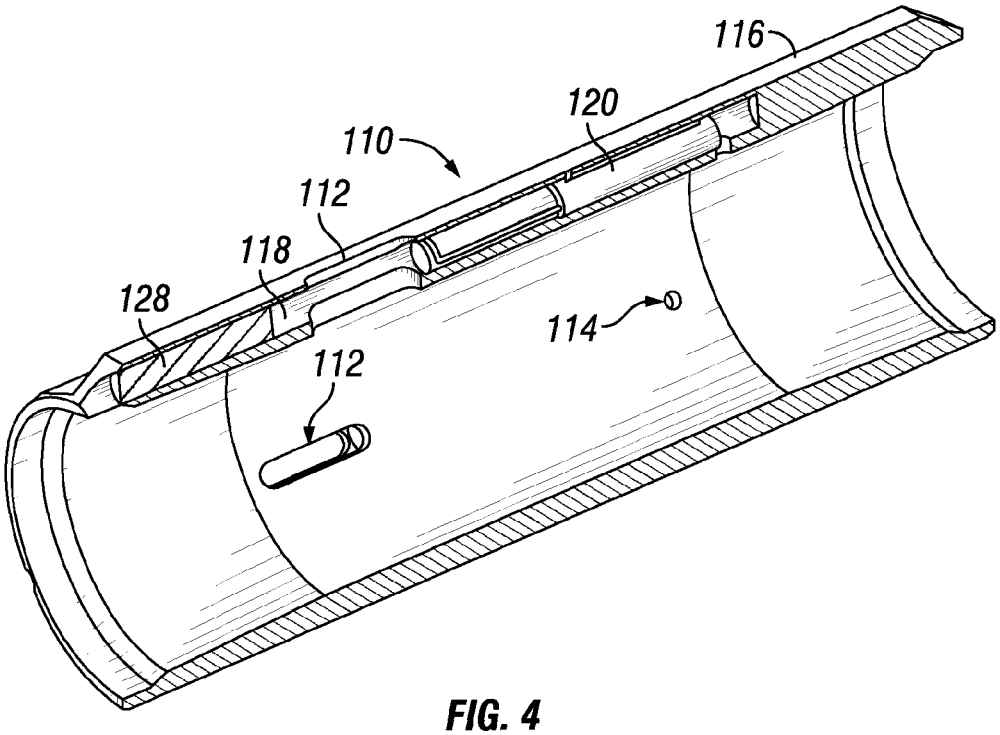
FIG. 4 illustrates a perspective view of a collar, according to an embodiment of the present disclosure.

A perspective view of collar 110 is illustrated in FIG. 4, according to an embodiment of the present disclosure. Collar 110 can include one or more fracture ports 112 and one or more valve vent holes 114. Fracture ports 112 can intersect valve holes 118, which can be positioned longitudinally in centralizers 116. A plug 128 can be positioned in valve holes 118 to prevent or reduce undesired fluid flow up through valve holes 118. In an embodiment, the inner diameter 113 (shown in FIG. 2) of the collar 110 can be approximately the same or greater than the inner diameter of the casing 104. In this way, the annulus between the collar 110 and the BHA 102 is not significantly restricted. In other embodiments, the inner diameter of the collar 110 can be less than the inner diameter of the casing 104. Collar 110 can attach to casing lengths 106 by any suitable mechanism. In an embodiment, collar 110 can include two female threaded portions for connecting to threaded male ends of the casing lengths 106B and 106C.

Figure 5:
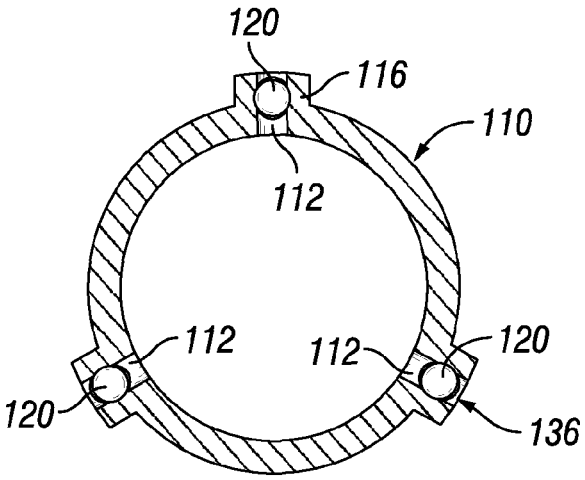
FIG. 5 illustrates a cross-sectional view of the collar of FIG. 4, according to an embodiment of the present disclosure.

As more clearly shown in FIG. 5, fracture ports 112 can be positioned through centralizers 116, which can allow the fracture port 112 to be positioned relatively close to the formation. Where the casing is to be cemented into the wellbore, this can increase the chance that the fracture ports 112 will reach through, or nearly through, the cement.

Figure 6:
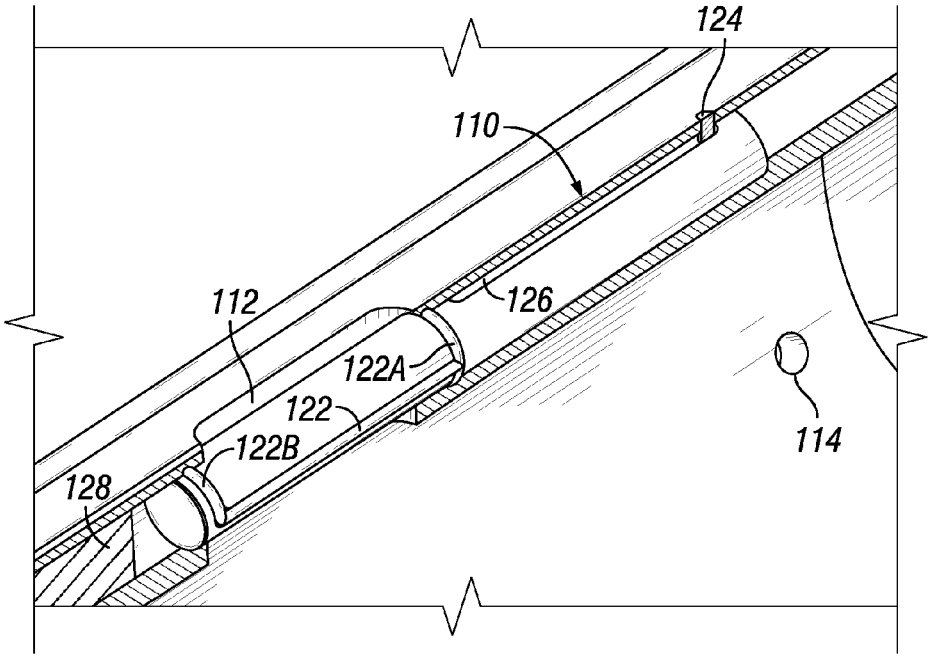
FIG. 6 illustrates a valve used in the collar of FIG. 4, according to an embodiment of the present disclosure.

Valves 120 for controlling fluid flow through fracture ports 112 are positioned in the valve holes 118 of centralizers 116. When the valves 120 are in the closed position, as illustrated in FIG. 6, they prevent or reduce the flow of fluid through the fracture ports 112.

Valves 120 can include one or more seals to reduce leakage. Any suitable seal can be employed. An example of a suitable seal 122 is illustrated in FIG. 6. Seal 122 can be configured to extend around the fracture port 112 when valve 120 is positioned in the closed position. Seal 122 can include a ring 122A that fits around the circumference of valve 120 at one end and a circular portion 122B that extends only around a portion of the valve 120 at the opposite end. This configuration can provide the desired sealing effect while being easy to manufacture.

A shear pin 124 can be used to hold the valve 120 in the closed position during installation and reduce the likelihood of valve 120 opening prematurely. Shear pin 124 can be designed so that when it is sheared, a portion of the pin 124 remains in the wall of collar 110 and extends into groove 126 of valve 120. This allows the sheared portion of pin 124 to act as a guide by maintaining the valve 120 in a desired orientation so that seal 122 is positioned correctly in relation to fracture port 112. The use of sheared pin 124 as a guide is illustrated in FIG. 2, which shows the valve 120 in open position.

Collar 110 can be attached to the casing lengths in any suitable manner. In an embodiment, collar 110 can include two female threaded portions for connecting to threaded male ends of the casing lengths 106, as illustrated in FIG. 2.

As also shown in FIG. 2, a packer 130 can be positioned in the casing between the fracture ports 112 and the valve vent hole 114. When the packer 130 is energized, it seals on the inner diameter of the collar 110 to prevent or reduce fluid flow further down the well bore annulus. Thus, when fluid flows downhole from surface in an annulus between a well casing 104 and a BHA 102, a pressure differential is formed across the packer between the fracture port 112 and the valve vent hole 114. The pressure differential can be used to open the valve 120.

Any suitable technique can be employed to position the packer 130 at the desired position in the collar 110. One example technique illustrated in FIG. 3 employs a dog 132 that can be configured so as to drive into a recess 134 between casing portions 106A and 106B. As shown in FIG. 1, the dog 132 can be included as part of the BHA 102. The length of the casing portion 106B can then be chosen to position the collar 110 a desired distance from the recess 134 so that the packer 130 can be positioned between the fracture port 112 and the valve vent hole 114. During installation, the well operator can install the BHA 102 by lowering the dog past the recess 134 and then raising the BHA 102 up until the dog 132 drives into the recess 134. An extra resistance in pulling dog 132 out of the recess 134 will be detectable at the surface and can allow the well operator to determine when the BHA 102 is correctly positioned in the casing. This can allow the well operator to locate the packer 130 relative to the standard collar 108, which can be the next lowest collar relative to collar 110.

Figure 8:
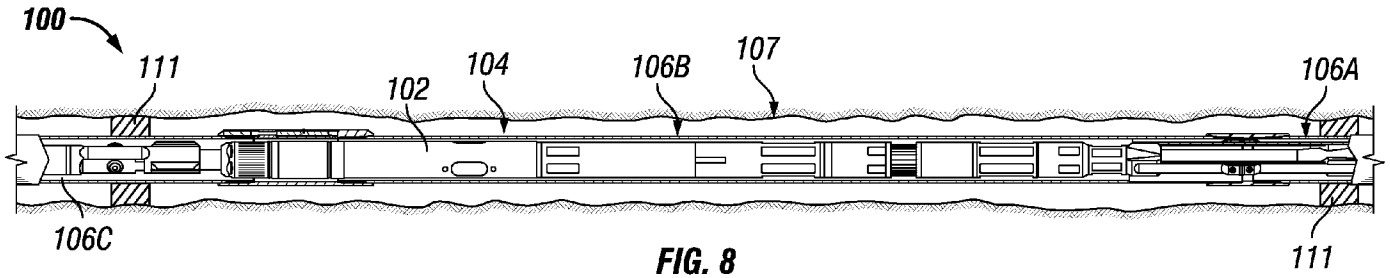
FIG. 8 illustrates a portion of a well completion with open-hole packers, according to an embodiment of the present disclosure.

The casing 104 can be installed after well drilling as part of the completion 100. In an embodiment, the casing 104, including one or more collars 110, can be cemented into the wellbore. FIG. 1 illustrates the cement 105, which is flowed into the space between the outer diameter of the casing 104 and the inner diameter of the wellhole 107. Techniques for cementing in casing are well known in the art. In another embodiment, the casing 104 and collars 110 can be installed in the wellbore using an open hole packer arrangement where instead of cement, packers 111 are positioned between the inner diameter of the wellbore 107 and the outer diameter of the casing 104, as illustrated in FIG. 8. Such open hole packer completions are well known in the art and one of ordinary skill in the art would readily be able to apply the collars of the present application in an open hole packer type completion.

The collars 110 can be positioned in the casing wherever ports are desired for fracturing. For example, it is noted that while a standard collar 108 is shown as part of the casing, collar 108 can be replaced by a second collar 110. In an embodiment, the collars 110 of the present disclosure can be positioned in each zone of a multi-zone well.

During the cementing process, the casing is run in and cement fills the annular space between casing 104 and the well formation. Where the valve 120 is positioned in the centralizer, there can be a slight depression 136 between the outer diameter of the centralizer 116 and the outer diameter of valve 120, as shown in FIG. 5. The depression 136 can potentially be filled with cement during the cementing process. Therefore, before fluid flows through the valve 120, there may be a thin layer of cement that will have to be punched through. Alternatively, the depression 136 may not be filled with cement. In an embodiment, it may be possible to fill the depression 136 with grease, cement inhibiting grease, or other substance prior to cementing so as to reduce the likelihood of the depression 136 being filled with cement.

A potential advantage of the collar design of FIG. 4 is that opening valve 120 displaces fluid volume from the valve hole 118 into an annulus between the casing 106 and the BHA 102 through the valve vent hole 114. Thus, all of the displaced volume that occurs when opening the valves 120 is internal to the completion. This allows filling the space between the wellbore and the outer diameter of casing 106 with cement, for example, without having to necessarily provide a space external to the collar for the fluid volume that is displaced when valve 120 is opened.

Another possible advantage of the collar design of FIG. 4 is that little or no pressure differential is likely to be realized between the fracture port 112 and the valve vent hole 114 of a collar 110 until the inner diameter of the collar is sealed off between the fracture port 112 and the valve vent hole 114. This means that in multi-zone wells having multiple collars 110, the operator can control which fracture port is opened by position the sealing mechanism, such as the packer 130, in a desired location without fear that other fracture ports at other locations in the well will inadvertently be opened.

The collars of the present disclosure can be employed in any type of well. Examples of well types in which the collars can be used include horizontal wells, vertical wells and deviated wells.

The completion assemblies shown above with respect to FIGS. 1 to 3 are for annular fracturing techniques where the fracturing fluid is pumped down a well bore annulus between a well casing 104 and a BHA 102. However, the collars 110 of the present disclosure can also be employed in other types of fracturing techniques.

Figure 7:
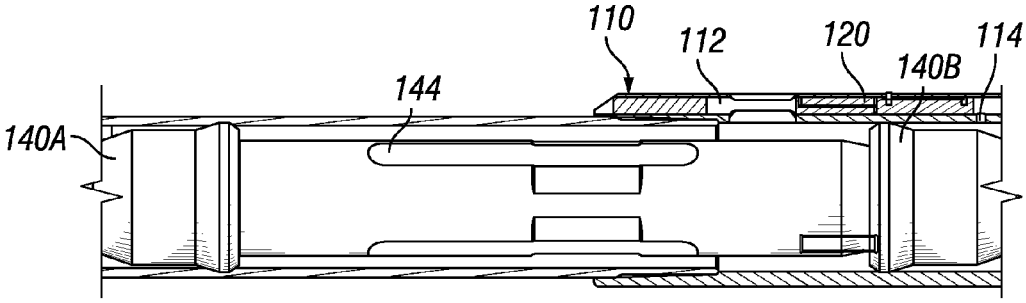
FIG. 7 illustrates a collar being used with a coiled tubing string and a straddle tool having packers for isolating a zone in the well to be fractured, according to an embodiment of the present disclosure.

One such fracturing technique is illustrated in FIG. 7, where a coiled tubing string is employed with a straddle tool having packers 140A, 140B for isolating a zone in the well to be fractured. As shown in FIG. 7, the packer 140B can be positioned between the fracture port 112 and the valve vent hole 114. This allows valve 120 to be opened by creating a pressure differential between fracture port 112 and valve vent hole 114 when the area in the wellbore between packers 140A, 140B is pressured up. Pressuring up can be accomplished by flowing a fluid down the coiled tubing at a suitable pressure for opening the valve 120. The fluid for opening valve 120 can be a fracturing fluid or another suitable fluid. After the valve 120 is opened, fracturing fluid (not shown) can be pumped downhole through coiled tubing, into the annulus through aperture 144 and then into the formation through fracture port 112. A potential advantage of the coiled tubing/straddle tool assembly of FIG. 7 is that any proppant used during the fracturing step can be isolated between the packers 140A and 140B from the rest of the wellbore annulus.

A method for multi-zone fracturing using the collars 110 of the present disclosure will now be described. The method can include running the casing 104 and collars 110 into the wellhole after drilling. The casing 104 and collars 110 can be either set in the wellhole by cementing or by using packers in an openhole packer type assembly, as discussed above. After the casing is set in the wellhole, a BHA 102 attached to the end of coiled tubing string can be run into the well. In an embodiment, the BHA 102 can initially be run to, or near, the bottom of the well. During the running in process, the dogs 132 (FIG. 3) are profiled such that they do not completely engage and/or easily slide past the recesses 134. For example, the dogs 132 can be configured with a shallow angle 131 on the down hole side to allow them to more easily slide past the recess 134 with a small axial force when running into the well.

After the BHA 102 is run to the desired depth, the well operator can start pulling the tubing string and BHA 102 up towards the surface. Dogs 132 can be profiled to engage the recess 134 with a steep angle 133 on the top of the dogs 132, thereby resulting in an increased axial force in the upward pull when attempting to pull the dogs 132 out of the recesses. This increased resistance allows the well operator to determine the appropriate location in the well to set the packer 130, as discussed above. Profiling the dogs 132 to provide a reduced resistance running into the well and an increased resistance running out of the well is generally well known in the industry. After the packer 130 is positioned in the desired location, the packer 130 can then be activated to seal off the well annulus between the BHA 102 and the desired collar 110 between the fracture port 112 and the valve vent hole 114.

After the well annulus is sealed at the desired collar 110, the well annulus can be pressured up from the surface to a pressure sufficient to open the valves 120. Suitable pressures can range, for example, from about 100 psi to about 10,000 psi, such as about 500 psi to about 1000 psi, 1500 psi or more. The collar 110 is designed so that all of the fracture ports 112 in the collar may open. In an embodiment, the pressure to open the fracture ports 112 can be set lower than the fracturing pressure. This can allow the fracturing pressure, and therefore the fracturing process itself, to ensure all the fracture ports 112 are opened. It is contemplated, however, that in some situations all of the fracture ports 112 may not be opened. This can occur due to, for example, a malfunction or the fracture ports being blocked by cement. After the fracture ports 112 are opened, fluids can be pumped through the fracture ports 112 to the well formation. The fracture process can be initiated and fracturing fluids can be pumped down the well bore to fracture the formation. Depending on the fracturing technique used, this can include flowing fracturing fluids down the well bore annulus, such as in the embodiment of FIGS. 1 to 3. Alternatively, fracturing fluids can be flowed down a string of coiled tubing, as in the embodiment of FIG. 7. If desired, a proppant, such as a sand slurry, can be used in the process. The proppant can fill the fractures and keep them open after fracturing stops. The fracture treatment typically ends once the final volume of proppant reaches the formation. A displacement fluid is used to push the proppant down the well bore to the formation.

A pad fluid is the fluid that is pumped before the proppant is pumped into the formation. It ensures that there is enough fracture width before the proppant reaches the formation. If ported collar assemblies are used, it is possible for the displacement fluid to be the pad fluid for the subsequent treatment. As a result, fluid consumption is reduced.

In multi-zone wells, the above fracturing process can be repeated for each zone of the well. Thus, the BHA 102 can be set in the next collar 110, the packer can be energized, the fracturing port 112 opened and the fracturing process carried out. The process can be repeated for each zone from the bottom of the wellbore up. After fracturing, oil can flow out the fracture through the fracture ports 112 of the collars 110 and into the well.

In an alternative multi-zone embodiment, the fracturing can potentially occur from the top down, or in any order. For example, a straddle tool, such as that disclosed in FIG. 7, can be used to isolate the zones above and below in the well by techniques well known in the art. The fracture ports 112 can then be opened by pressuring up through the coiled tubing, similarly as discussed above. Fracturing can then occur for the first zone, also in a similar fashion as described above. The straddle tool can then be moved to the second zone form the surface and the process repeated. Because the straddle tool can isolate a collar from the collars above and below, the straddle tool permits the fracture of any zone along the wellbore and eliminates the requirement to begin fracturing at the lower most zone and working up the casing.

The design of the collar 110 of the present disclosure can potentially allow for closing the valve 120 after it has been opened. This may be beneficial in cases were certain zones in a multi-zone well begin producing water, or other unwanted fluids. If the zones that produce the water can be located, the collars associated with that zone can be closed to prevent the undesired fluid flow from the zone. This can be accomplished by isolating the valve vent hole 114 and then pressuring up to force the valve 120 closed. For example, a straddle tool can be employed similar to the embodiment of FIG. 7, except that the packer 140A can be positioned between the fracture port 112 and the valve vent hole 114, and the lower packer 140B can be positioned on the far side of the valve vent hole 114 from packer 140A. When the zone between the packers is pressurized, it creates a high pressure at the valve vent hole 114 that forces the valve 120 closed.

Erosion of the fracture port 112 by the fracturing and other fluids can potentially prevent the valve 120 from sealing effectively to prevent fluid flow even through the fracture port 112 is closed. However, it is possible that the design of the collar 110 of the present disclosure, which allows multiple fracture ports in a single collar to open, may help to reduce erosion as compared to a design in which only a single fracture port were opened. This is because the multiple fracture ports can provide a relatively large flow area, which thereby effectively decreases the pressure differential of the fluids across the fracture port during fracturing. The decreased pressure differential may result in a desired reduction in erosion.

Figure 10:
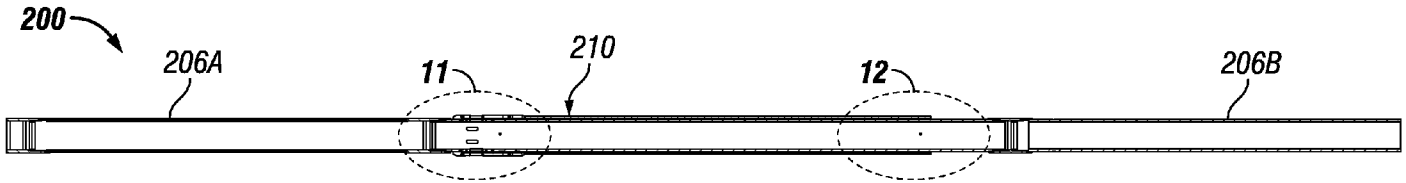
FIG. 10 illustrates a bottom hole assembly used in a wellbore completion, according to an embodiment of the present disclosure.
Figure 11:
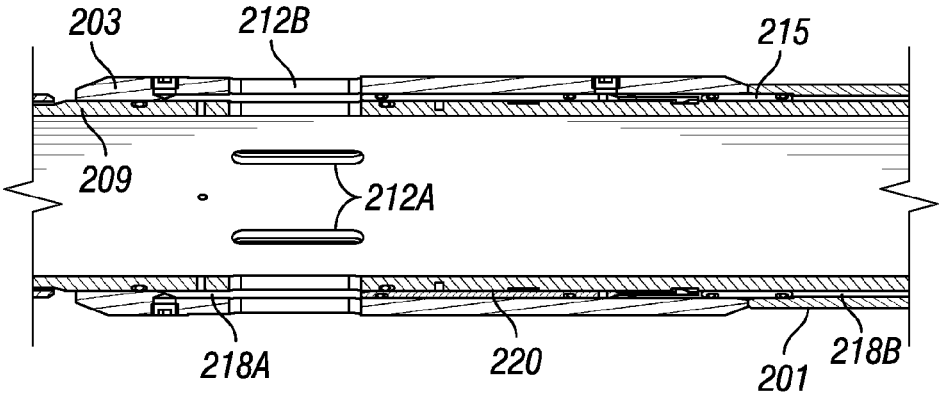
FIG. 11 illustrates a close up view of the upper portion of a collar and bottom hole assembly embodiment shown in FIG. 10.
Figure 12:
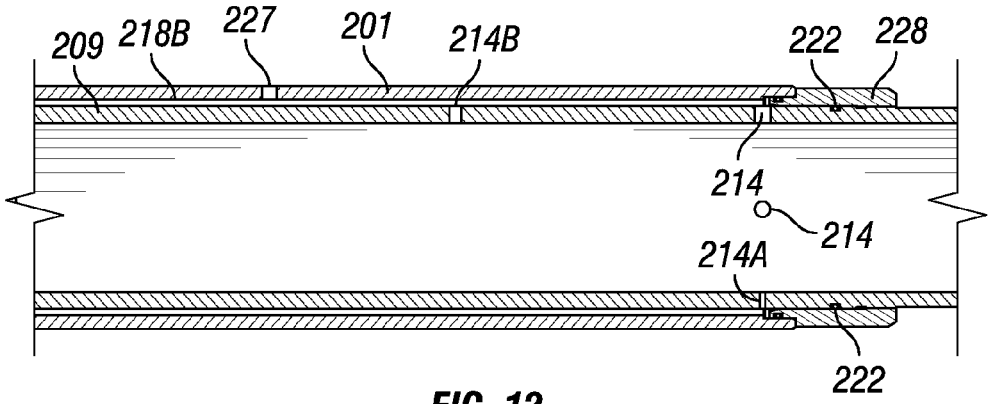
FIG. 12 illustrates a close up view of a lower portion of the collar and bottom hole assembly embodiment shown in FIG. 10.

FIG. 10 illustrates a portion of a wellbore completion 200, according to an embodiment of the present disclosure. The wellbore completion includes casing lengths 206*a*, 206*b* connected to a collar assembly 210, herein after referred to as collar 210. FIG. 11 shows a close-up view of the upper portion of the collar 210 and FIG. 12 shows a close-up view of the lower portion of the collar 210. The collar 210 shown in FIG. 11 comprises a mandrel 209, which may comprise a length of casing length, a valve housing 203, and a vent housing 201. A valve, such as a sleeve 220, is positioned within an annulus 218 between the mandrel 209 and the valve housing 203. The sleeve 220 is movable between an open position (shown in FIG. 10) that permits communication between the inner diameter of the mandrel 209 and outer fracture ports 212B through inner fracture port 212A located in the mandrel 209. The annulus 218A extends around the perimeter of the mandrel and is in communication with the annulus 218B between the vent housing 201 and the mandrel 209, which may be referred to as a single annulus 218. The sleeve 220 may be moved into a closed position (shown in FIG. 15) preventing fluid communication between the inner fracture port 212A and outer fracture port 212B, which may be referred to collectively as the fracture port 212. The sleeve 220 effectively seals the annulus 218 into an upper portion 218A and 218B thus, permitting a pressure differential between the two annuluses to move the sleeve 220 between its open and closed positions. A seal ring 215 may be used connect the valve housing 203 to the vent housing 201. Grooves 218C in the mandrel under the seal ring ensure good fluid communication past the seal ring 215 between the upper portion 218A and lower portion 218B of the annulus 218. Alternatively, the valve housing and the vent housing may be a single housing. In this embodiment, a seal ring to connect the two housings and grooves in the mandrel to provide fluid communication would not be necessary.

FIG. 12 shows that the lower portion of the vent housing 201 and the mandrel 209 having an annulus 218B between the two components. A lower nut 228 connects the lower end of the vent housing 201 to the mandrel 209 with sealing elements 222 sealing off the lower portion of the annulus 218B. The mandrel 209 includes a vent hole 214 that is in communication with the annulus 218. In one embodiment, a plurality of vent holes 214 are positioned around the mandrel 209. The mandrel may include one or more vent holes 214B at a different location the primary vent holes 214. In operation a burstable device, such as a burst plug, or cement inhibiting grease may fill each of the vent holes to prevent cement, or other undesired substances, from entering into the annulus 218. In addition to the burst plugs, cement inhibiting grease may be injected into the annulus 218 prior to the completion being run into the wellbore to prevent the ingress of cement into the annulus 218 while the completion is cemented into a wellbore. The vent housing 201 may include a fill port 227 to aid in the injection of grease into the annulus 218. Preferably, one of the vent holes may be significantly smaller in diameter than the rest of the vent holes and not include a burst plug. After bursting the burst plugs, the vent holes permit the application of pressure differential in the annulus 218 to open or close the valve 220, as detailed above. In the event that the cement has entered into the annulus 218 via the vent holes 214, the vent housing may include secondary vent hole(s) 214B farther uphole along the mandrel 209 that may permit communication to the annulus 218.

Figure 13:
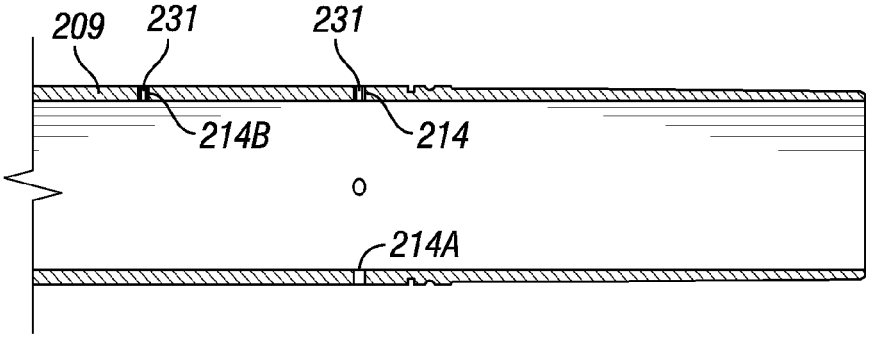
FIG. 13 illustrates close up view of a portion of a mandrel of a bottom hole assembly, according to an embodiment of the present disclosure.

FIG. 13 illustrates the downhole portion of the mandrel 209 without the vent housing 201. Burst plugs 231 have been inserted into vent holes 214, 214B. Preferably, a burst plug is not inserted into the smallest vent hole 214A, which may be approximately ⅛ inch in diameter. The vent housing 201 is adapted to provide predetermined distance between the fracture ports 212 and the vent hole(s) 214. The vent holes 214 may be approximately two (2) meters from the fracture ports to provide adequate spacing for the location of a packing element to permit the application of a pressure differential. It is difficult to position the packing element accurately, within half of a meter, in the well bore. In addition, the position of the collars relative to each other is often not accurately known, largely due to errors in measurements taken when the completion is installed into the well bore. The challenge to accurately position the packing element within the well bore is due to several factors. One factor is the equipment used to measure the force exerted on the coiled tubing while pulling out of the hole is not exact, often errors of 1000 lbs. force or more can occur. The casing collar locating profile (133) of FIG. 1 typically increases the force to pull out of the hole by 2000 lbs. In addition, the frictional force between the coiled tubing and the casing in a horizontal well is high and not constant, while pulling out of the well. As a result it can be difficult to know what is causing an increase in force observed at the surface. It could be due to the casing collar locator pulling into a coupling or it could be due to other forces between the coiled tubing and the completion and/or proppant. A strategy used to improve the likelihood of determining the position of the packing element is to use short lengths of casing, typically two (2) meters long, above and below the collar assembly. In this way there are three or four couplings (dependent on the configuration of the collar) at known spacing distinct from the standard length of casing, which are typically thirteen (13) meters long. As a result of using short lengths of casing attached directly to the collar assembly, absolute depth measurement relative to the surface or relative to a recorded tally sheet are no longer required. However, this distance between the fracture port and the vent hole may be varied to accommodate various packing elements or configurations to permit the application of a pressure differential as would be appreciated by one of ordinary skill in the art having the benefit of this disclosure.

Figure 9:
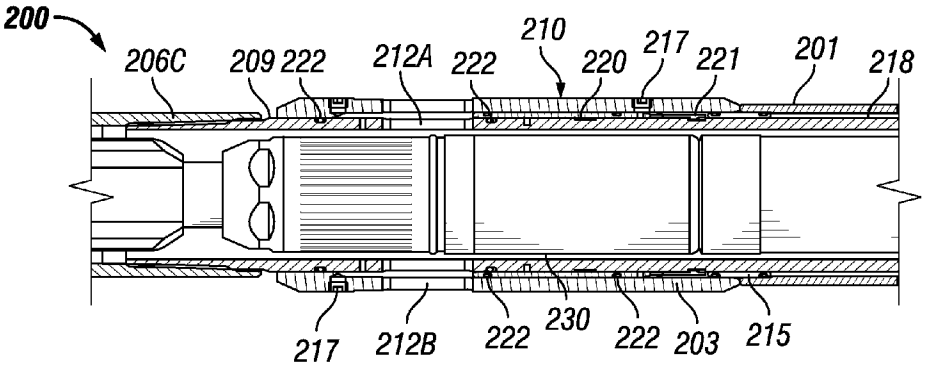
FIG. 9 illustrates a close up view of a collar and bottom hole assembly, according to an embodiment of the present disclosure.

FIG. 9 illustrates a portion of a wellbore completion 200, according to an embodiment of the present disclosure that includes a BHA inside of a casing made up of a plurality of casing lengths 206 connected together via a plurality of collars, such as collar 210. The collar 210 in this embodiment is comprised of a mandrel 209, a valve housing 203, and a vent housing 201. A valve, such as a sleeve 220, is positioned within an annulus 218 between the mandrel 209 and the valve housing 203. The sleeve 220 is movable between an open position (shown in FIG. 9) that permits communication between the inner diameter of the mandrel 209 and the outer fracture ports 212B via the inner fracture ports 212A. The sleeve 220 includes a collet finger 221 that is configured to engage a recess 223 (shown on FIG. 15) on the mandrel 209 to selectively retain the sleeve 220 in its open position. Sealing elements 222 may be used to provide seal between the valve housing 203, the mandrel 209, and the sleeve 220. The valve housing 203 may include one or more fill ports 217 that permits the injection of grease or other cement inhibiting substances into the annulus 218 to prevent the ingress of cement if the completion 200 is cemented into the wellbore.

Figure 15:
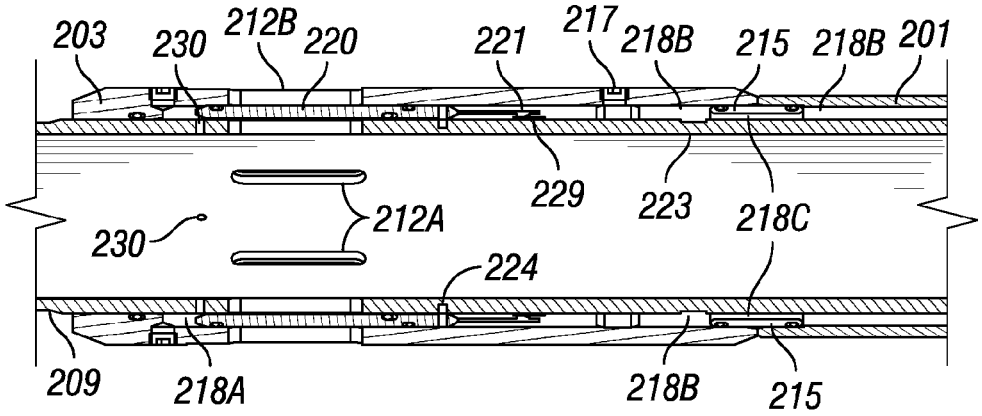
FIG. 15 illustrates a cross-section view of a collar having a valve in the closed position, according to an embodiment of the present disclosure.

FIG. 15 shows a cross-section view of the upper portion of the collar 210 with the sleeve 220 in a closed position. A shear pin 224 selectively retains the sleeve 220 in the closed position. The shear pin 224 can be used to hold the sleeve 220 in the closed position during installation and reduce the likelihood of sleeve 220 (or valve 120) opening prematurely. The shear pin 224 may be adapted to shear and release the sleeve 220 upon the application of a predetermined pressure differential as would be appreciated by one of ordinary skill in the art. The mandrel 209 may include one or more ports 230 that are positioned uphole of the closed sleeve 220 to aid in the application of a pressure differential into the annulus 218A above the sleeve 220 when moving the sleeve 220 to the open position. After opening the sleeve and fracturing the wellbore, the sleeve 220 may be moved back to the closed position upon the application of a pressure differential as discussed above. The ports 230 in the mandrel 209 may permit the exit of fluid from the annulus 218A as the sleeve 220 passes the fracture ports 212 as it moves to the closed position. The mandrel 209 may include a recess 229 adapted to mate with the collet finger 221 and selectively retain the sleeve 220 in the closed position until the application of another pressure differential. In the shown embodiment, the sleeve 220 encompasses the entire perimeter of the mandrel 209. Alternatively, a plurality of sleeves may be used to selectively permit fluid communication with the fracture ports 212.

Figure 14:
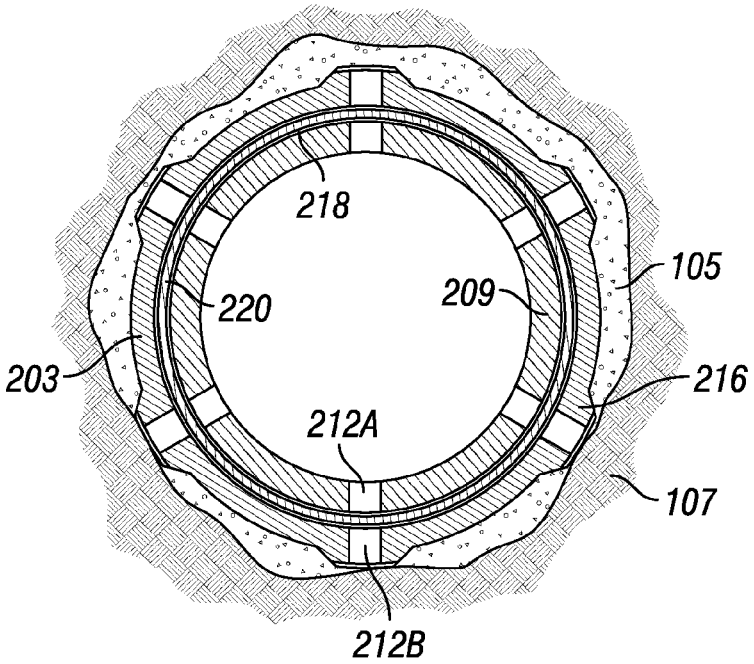
FIG. 14 illustrates a cross-sectional end view of the collar of FIG. 11.

The collar 210 can include one or more inner fracture ports 212A, one or more outer fracture ports 212B, and one or more valve vent holes 214 (shown in FIG. 12). The outer fracture ports 212B intersect the annulus 218 and may be positioned in centralizers 216 along the outside of the collar 210 (as shown in FIG. 14). In an embodiment, the inner diameter of the collar 210 can be approximately the same or greater than the inner diameter of the casing. In this way, the annulus between the collar 210 and the BHA is not significantly restricted. One potential challenge of this process is the reliable use of a packer that is typically used within casings that potentially have a large variation in the inner diameter between the segments of casing. The use of ported collars 210 may decrease this potential problem because the ported collars 210 can be made with a smaller variation in the inner diameter as well as having a less oval shape than typical casing. These improvements provide improved reliability for properly sealing off within the collars 210 with a typical packer. In other embodiments, the inner diameter of the collar 210 can be less than the inner diameter of the casing. However, the inner diameter of the collar 210 may still be within tolerance limits of the inner diameter of the casing. Collar 210 can attach to casing lengths 106 by any suitable mechanism. In an embodiment, collar 210 can include two female threaded portions for connecting to threaded male ends of the casing lengths 206*b* and 206*c*.

As more clearly shown in FIG. 14, the outer fracture ports 212B can be positioned through centralizers 216, which can allow the outer fracture port 212B to be positioned relatively close to the formation 107. Where the casing is to be cemented into the wellbore, this can increase the chance that the fracture ports 112 will reach through, or nearly through, the cement 105. As shown in FIG. 14, one or more of the centralizers 216 may be in direct contact with the open hole formation 107, which may be the centralizers 216 on the lower side in a horizontal well as would be appreciated by one of ordinary skill in the art having the benefit of this disclosure. A valve, such as a sleeve 220, may be positioned in an annulus in fluid communication with both inner fracture ports 212A and outer fracture ports 212B. The annulus 218 may be between the mandrel 209 and an outer valve housing 203. When the sleeve 220 is in the closed position, as illustrated in FIG. 15, it prevents or reduces the flow of fluid through the fracture ports 112.

As shown in FIG. 9, a packer 230 can be positioned in the casing between the fracture ports 212 and the valve vent holes 214. When the packer 230 is energized, it seals on the inner diameter of the collar 210 to prevent or reduce fluid flow further down the well bore annulus. Thus, when fluid flows downhole from surface in the annulus between a well casing 104 and a BHA, a pressure differential is formed across the packer between the fracture ports 212 and the valve vent holes 214. The pressure differential can be used to open the valve 220. The user of the packer in FIG. 9 to create a differential pressure is provided for illustrative purposes as various tools and techniques may be employed to create a differential pressure to open and/or close the valves, as would be appreciated by one of ordinary skill in the art. For example, a rotary jetting tool could potential run into casing and directed to the valve vent holes to create the pressure differential required to close the valve.

As discussed above, during the cementing process the casing is run in and cement is pumped down the central bore of the casing and out of the end of the casing 104 filling the annular space between casing 104 and the well formation. To prevent ingress of cement and/or fluids used during the cementing process, grease or other substance may be injected into the annulus 218 of the collar 210 prior to running the casing into the wellbore. Burst plugs may be inserted into the valve vent holes 214 and grease may be injected into the annulus through injection ports in the valve housing 203 and the vent housing 201. Afterwards the injection ports may be plugged.

Figure 16:
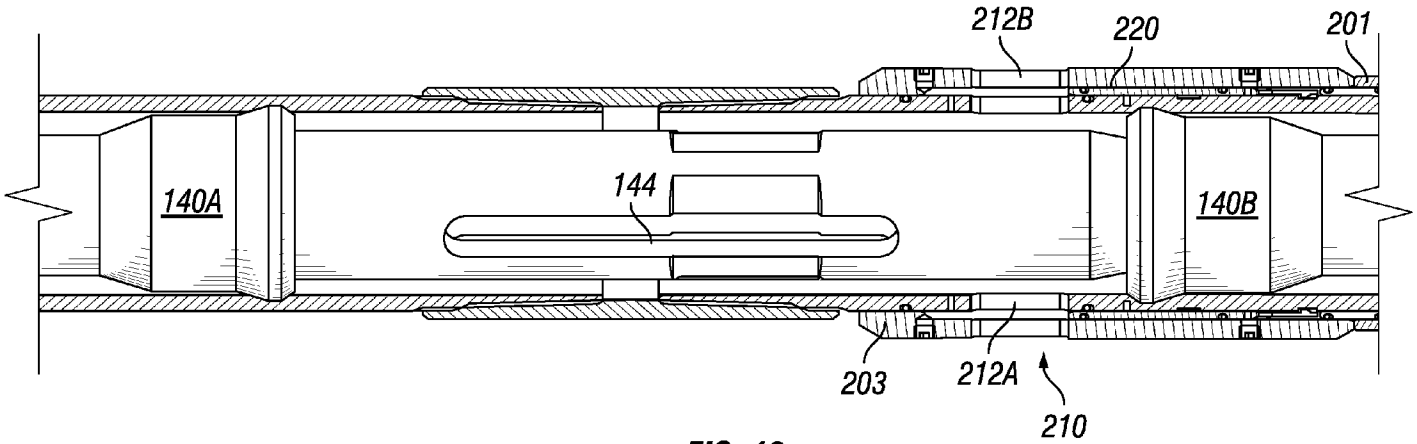
FIG. 16 illustrates a collar being used with a coiled tubing string and a straddle tool having packers for isolating a zone in the well to be fractured, according to an embodiment of the present disclosure.

FIG. 16 shows one technique used to open the sleeve 220 to fracture the formation. A coiled tubing string is employed with a straddle tool having packers 140A,140B for isolating a zone in the well to be fractured. FIG. 16 shows only a portion of the straddle tool that may be used with the collar assembly of the present disclosure. As shown in FIG. 16, the downhole packer 140B can be positioned between the fracture ports 212 and the valve vent holes 214 (shown in FIG. 12). This allows sleeve 220 to be opened by creating a pressure differential between the fracture ports 212 and valve vent holes 214 when the area in the wellbore between packers 140A, 140B is pressured up. Pressuring up can be accomplished by flowing a fluid down the coiled tubing and out of aperture 144 at a suitable pressure for opening the valve 220. The fluid use to open the sleeve 220 may be fracturing fluid. A potential advantage of the coiled tubing/straddle tool assembly of FIG. 16 is that any proppant used during the fracturing step can be isolated between the packers 140A and 140B from the rest of the annulus. In one embodiment the sleeve 220 may be adapted to open at predetermined pressure differential well above the desire fracturing pressure. Thus, energy may be stored within the coiled tubing prior to opening the sleeve 220 and the formation may be fractured very rapidly after opening the fracture ports 212.

A method for multi-zone fracturing using the collars 210 of the present disclosure will now be described. The method can include running the casing 104 and collars 210 into the wellhole after drilling. The casing 104 and collars 210 can be either set in the wellhole by cementing or by using packers in an openhole packer type assembly, as discussed above. After the casing is set in the wellhole, a BHA attached to the end of coiled tubing string or jointed pipe can be run into the well. In an embodiment, the BHA can initially be run to, or near, the bottom of the well. During the running in process, the dogs 132 (FIG. 3) are profiled such that they do not completely engage and/or easily slide past the recesses 134. For example, the dogs 132 can be configured with a shallow angle 131 on the down hole side to allow them to more easily slide past the recess 134 with a small axial force when running into the well.

After the BHA is run to the desired depth, the well operator can start pulling the coiled tubing string and BHA up towards the surface. Dogs 132 can be profiled to engage the recess 134 with a steep angle 133 on the top of the dogs 132, thereby resulting in an increased axial force in the upward pull when attempting to pull the dogs 132 out of the recesses. This increased resistance allows the well operator to determine the appropriate location in the well to set the packer 230, as discussed above. Profiling the dogs 132 to provide a reduced resistance running into the well and an increased resistance running out of the well is generally well known in the industry. After the packer 230 is positioned in the desired location, the packer 230 can then be activated to seal off the well annulus between the BHA and the desired collar 210 between the fracture port 212 and the valve vent hole 214.

After the well annulus is sealed at the desired collar 210, the well annulus can be pressured up from the surface to a pressure sufficient to open the valve 220. Suitable pressures can range, for example, from about 100 psi to about 10,000 psi, such as about 500 psi to about 1000 psi, 1500 psi or more. As discussed above, the suitable pressure may be adapted to exceed the desired fracturing pressure to aid in the rapid fracture of the formation.

After the fracture ports 212 are opened, fluids can be pumped through the fracture ports 212 to the well formation. The fracture process can be initiated and fracturing fluids can be pumped down the well bore to fracture the formation. If desired, a proppant, such as a sand slurry, can be used in the process. The proppant can fill the fractures and keep them open after fracturing stops. After fracturing, the BHA can be used to remove any undesired proppant/fracturing fluid from the wellbore.

In multi-zone wells, the above fracturing process can be repeated for each zone of the well. Thus, the BHA can be set in the next collar 210, the packer can be energized, the fracturing ports 212 opened and the fracturing process carried out. The process can be repeated for each zone from the bottom of the wellbore up. After fracturing, oil can flow out the fracture through the fracture ports 212 of the collars 210 and into the well. When the BHA as shown in FIG. 1 is used, the first treatment may be placed at the bottom of the well and each subsequent treatment may be placed incrementally higher in the well. The fracturing treatments for each zone may be done all in a single trip of the BHA with minimal time required between the fracturing of each zone. The collar assemblies of the present disclosure that are positioned in the zones above the current treatment are exposed to current treatment well bore pressures. This pressure at times may be limited by the pressure rating of the casing. However, there is no risk of the valves of these collar assemblies prematurely opening because the pressure is balanced across the valves. The valves of the present disclosure can only be opened with a pressure differential between the fracture port and the valve vent hole. Further, the present disclosure provides for an efficient use of fluid during the fracturing process as the displacement fluid for a current zone being fractured can act as the pad fluid for the next zone to be treated.

The design of the collar 210 of the present disclosure can potentially allow for closing the valve 220 after it has been opened. This may be beneficial in cases were certain zones in a multi-zone well begin producing water, or some other unwanted fluids. If the zones that produce the water can be located, the collars associated with that zone can be closed to prevent the undesired fluid flow from the zone. This can be accomplished by isolating the valve vent hole 214 and then pressuring up to force the valve 220 closed. For example, a straddle tool can be employed similar to the embodiment of FIG. 16, except that the packer 140A can be positioned between the fracture ports 212 and the valve vent holes 214, and the lower packer 140B can be positioned on the far side of the valve vent holes 214 from packer 140A. When the zone between the packers is pressurized, it creates a high pressure at the valve vent holes 214 that forces the sleeve 220 closed. As discussed above, the sleeve 220 may include a collet finger 221 that may help retain the sleeve 220 in its closed position.

Figure 17:
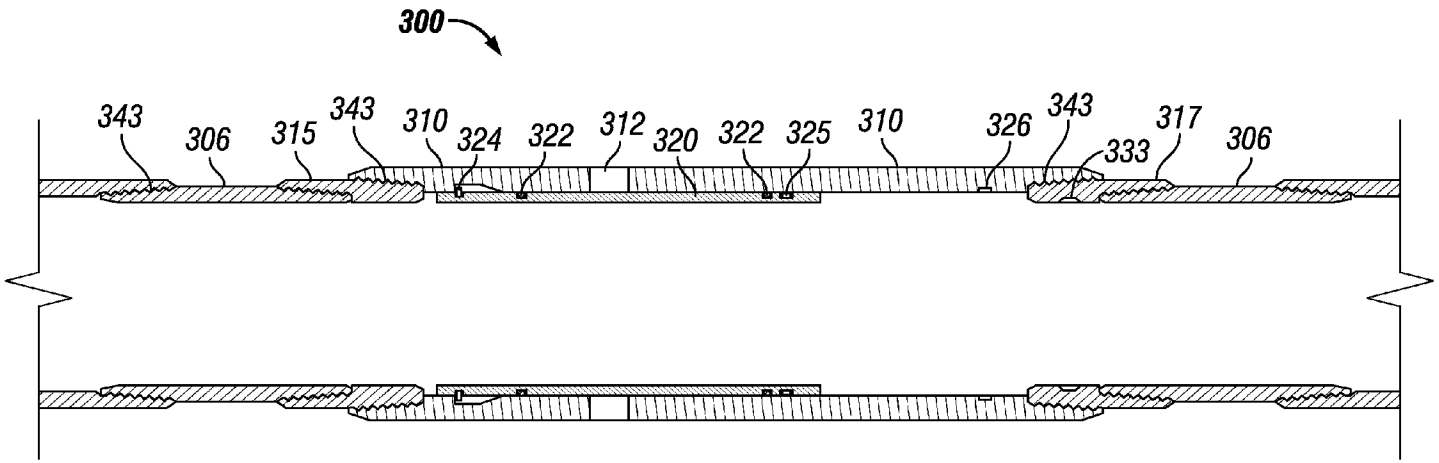
FIG. 17 illustrates a cross-section view of a ported wellbore completion according to an embodiment of the present disclosure.
Figure 18:
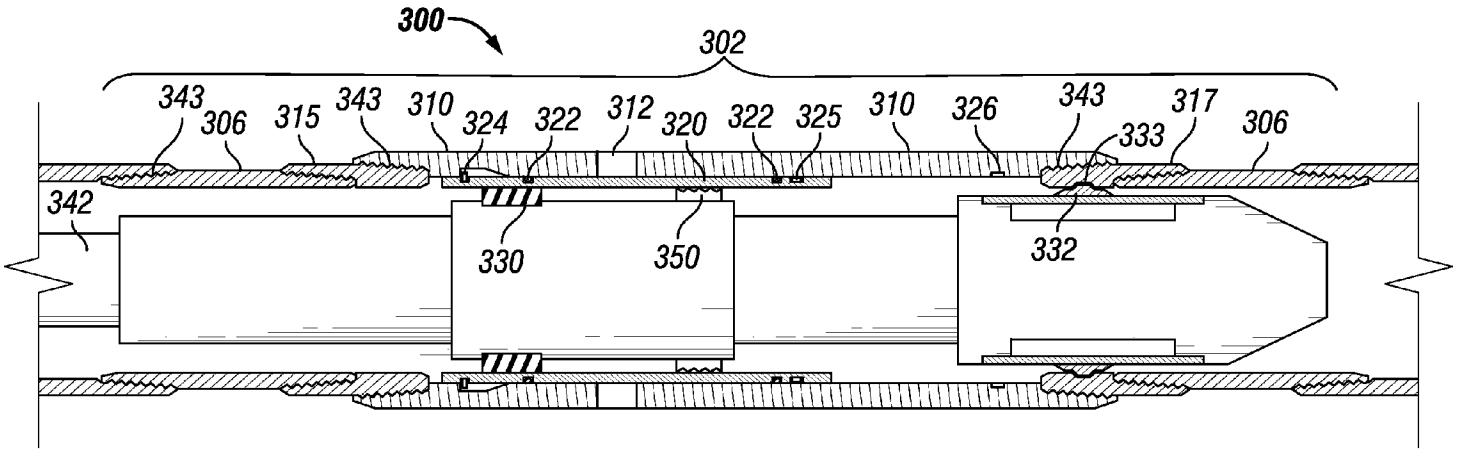
FIG. 18 illustrates a cross-section view of a bottom hole assembly anchored to a portion of the ported wellbore completion of FIG. 17, with the sleeve of the ported wellbore completion in a closed position.
Figure 19:
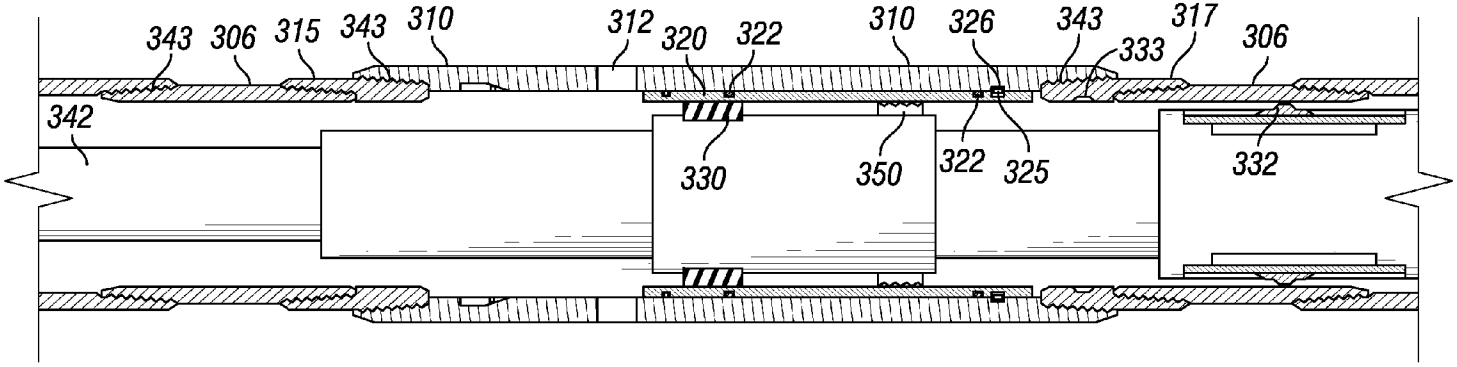
FIG. 19 illustrates a cross-section view of the bottom hole assembly anchored to a portion of the ported wellbore completion of FIG. 17, with the sleeve of the ported wellbore completion in an open position.

FIGS. 17-19 illustrate a portion of a wellbore completion 300, according to an embodiment of the present disclosure.

The wellbore completion 300 may includes a BHA 302 positioned inside of casing. The casing may be comprised of various segments and connectors connected together, such as pup joints 306, cross-overs 315 and 317, and a ported housing 310, as well as conventional casing tubulars, as would be appreciated by one of ordinary skill in the art having the benefit of this disclosure.

FIG. 17 shows a pup joint 306 connected to one end of a ported housing 310 by an upper cross-over 315. The other end of the ported housing 310 is connected to another pup joint 306 by a lower cross-over 317. The pup joints 306 may be connected to conventional casing tubulars to comprise a section of a casing string. The segments of the casing string are secured together via threads 343. The connection via threads and configuration of the casing segments are shown for illustrative purposes as different connection means and any suitable configurations may be used within the spirit of the disclosure. For example, the ported housing 310 could be connected directly to pup joints 306 without the use of cross-over connectors 315, 317.

The ported housing 310 includes at least one fracture port 312 that permits fluid communication between the interior and exterior of the housing 310. A sleeve 320 may be slidably connected to the interior surface of the housing 310. In an initial position, as shown in FIG. 17, the sleeve 320 may be positioned such that seals 322 prevent fluid communication through port 312. A shearable device 324 may be used to selectively retain the sleeve 320 in an initial closed position. The shearable device 324 may be a shear pin, crush ring, or other device adapted to selectively release the sleeve 320 from the housing 310 upon the application of a predetermined force, which may be applied by hydraulic pressure as discussed in detail below.

FIG. 18 shows a BHA 302 connected to coiled tubing 342 that has been inserted into the casing and has been positioned within the ported housing 310. A casing collar locator may be used to position the BHA 302 at desired proper location within the casing. For example, a lower cross-over 317 may include a profile 333 that is adapted to engage a profile 332 of the casing collar locator to properly position the BHA 302 within a specific ported housing 310 along the casing string.

The BHA 302 includes a packer 330 that may be activated to seal the annulus between the exterior of the BHA 302 and the interior diameter of the sleeve 320 of the ported housing 310. The BHA 302 also includes an anchor 350 that may be set against the sleeve 320. Application of pressure down the coiled tubing is used to activate the anchor 350 and set it against the sleeve 320 as well as to set the packer 330. A potential advantage of the embodiment of the BHA 302 is that the BHA 302 may be set within a housing 310 of the casing string without the use of a J-slot which requires the downward movement, upward movement, and then downward movement of the coiled tubing 342 to set the BHA 302. This repeated cyclic up and down movement of the coiled tubing 342 to set the BHA 302 may lead to more rapid failure of the coiled tubing 302. In comparison, the current embodiment of the BHA 302 and ported housing 310 and sleeve 320 provides for less movement of the coiled tubing 342. After a sleeve 320 has been opened, as discussed below, the BHA 302 may be released, moved up the casing string to the next desired zone, and set within the selected housing 310 without any cyclic up and down motion of the coiled tubing 342.

After setting the anchor 350 to secure the BHA 302 to the sleeve 320 and activating the packer 330, fluid may be pumped down the casing creating a pressure differential across the packer 330. Upon reaching a predetermined pressure differential, the shearable device 324 will shear and thereby release the sleeve 320 from the housing 310. The shearable device 324 may be adapted to shear at a predetermined pressure differential as will be appreciated by one of ordinary skill in the art.

After the shearable device releases the sleeve 320 from the housing 310, the increase pressure differential across the packer 330 will then move the BHA 302, which is anchored to the sleeve 320, down the casing. In this manner, the sleeve 320 can be moved from the closed position shown in FIG. 18 to an open position as shown in FIG. 19. Alternatively, the sleeve 320 may be moved to the open position by applying a downward force to the BHA 302 with the coiled tubing 342 or by the application of hydraulic pressure in combination with a downward force from the coiled tubing 342.

Upon moving to the open position, the sleeve 320 may be selectively locked into the open position. For example, the sleeve 320 may include an expandable device 325, such as a "c" ring or a lock dog, which expands into a groove 326 in the interior of the housing 310 selectively locking the sleeve 320 in the open position. In the open position, fluid may be communicated between the interior of the housing 310 to the exterior of the housing 310, permitting the treatment and/or stimulation of the well formation adjacent to the port 312.

A plurality of ported housings 310 with sleeves 320 can be positioned along the length of the casing at locations where fracturing is desired. After fracturing is carried out using a first ported housing 310 and sleeve 320, similarly as discussed above, the BHA can be moved to a second ported housing 310 comprising a second sleeve 320, where fracturing is carried out at a second location in the well. The process can be repeated until desired fracturing of the well is completed.

The use of a BHA 302 in connection with a ported housing 310 and sleeve 320 may provide an inexpensive system to selectively stimulate and/or treat a well formation as compared to other systems. For example, the configuration of the embodiment may permit the use of various lengths of housing and sleeves to locate a plurality of ports 312 along the casing string, for larger contact with the formation, as desired. Further, the confirmation of the embodiment may permit a large internal flow diameter in comparison to other fracturing/treatment systems.

Although various embodiments have been shown and described, the disclosure is not so limited and will be understood to include all such modifications and variations as would be apparent to one skilled in the art.

What is claimed is:

1. A wellbore completion system, the system comprising:

a housing operatively connected between two casing tubulars of a casing string, the housing including at least one port through the housing;

a sleeve connected to the housing, the sleeve being movable between a first position and a second position, wherein in the first position the sleeve prevents fluid communication through the port of the housing and, wherein the sleeve is moved downward from the first position to the second position;

a bottom hole assembly having a packing element and an anchor, the anchor being adapted to selectively connect the bottom hole assembly to the sleeve and the packing element being adapted to provide a seal between the bottom hole assembly and the sleeve;

a shearable device adapted to selectively retain the sleeve in the first position and release the sleeve from the first position upon the application of a pressure differential across the seal between the bottom hole assembly and the sleeve, wherein after the shearable device releases the sleeve the application of the pressure differential moves the bottom hole assembly downward to move the sleeve to the second position; and an expandable device adapted to selectively retain the sleeve in the second position.

2. The wellbore completion system of claim 1, wherein the expandable device is adapted to selectively engage a recess on the housing.

3. The wellbore completion system of claim 1, wherein the bottom hole assembly is connected to coiled tubing.

4. The wellbore completion system of claim 3, wherein the bottom hole assembly further comprises a collar casing locator.

5. The wellbore completion system of claim 1, wherein the anchor and packing element of the bottom hole assembly are pressure actuated.

6. A method for treating or stimulating a well formation, the method comprising:

positioning a bottom hole assembly within a portion of a casing string adjacent a first sleeve connected to the casing string, wherein the first sleeve is movable between a first position that prevents fluid communication through a first port in the casing string and a second position that permits fluid communication through the first port in the casing string;

connecting a portion of the bottom hole assembly to the first sleeve;

creating a seal between the bottom hole assembly and the sleeve; and applying a pressure differential across the seal moving the bottom hole assembly down the casing string to move the first sleeve from the first position to the second position, wherein the seal is created prior to moving the first sleeve from the first position to the second position.

7. The method of claim 6 further comprising treating the well formation adjacent to the first port in the casing string.

8. The method of claim 7 further comprising disconnecting the bottom hole assembly from the first sleeve.

9. The method of claim 8 further comprising:

positioning the bottom hole assembly within a portion of the casing string adjacent a second sleeve connected to the casing string, wherein the second sleeve is movable between a first position that prevents fluid communication through a second port in the casing string and a second position that permits fluid communication through the second port in the casing string;

connecting a portion of the bottom hole assembly to the second sleeve;

creating a seal between the bottom hole assembly and the second sleeve; and applying a pressure differential across the seal moving the bottom hole assembly down the casing string to move the second sleeve from the first position to the second position.

10. The method of claim 9 further comprising treating the well formation adjacent to the second port in the casing string.

11. The method of claim 6, wherein connecting a portion of the bottom hole assembly to the sleeve further comprises activating an anchor of the bottom hole assembly to engage a portion of the sleeve.

12. The method of claim 11 further comprising selectively releasing the sleeve from the first position before moving the bottom hole assembly.

13. The method of claim 12, wherein selectively releasing the sleeve further comprising shearing a shearable device.

14. The method of claim 13, wherein shearing the shearable device further comprises increasing pressure in the casing string above the bottom hole assembly to a predetermined amount.

15. The method of claim 13, wherein shearing the shearable device further comprises moving coiled tubing down the casing string, the coiled tubing being connected to the bottom hole assembly.

16. The method of claim 13, wherein shearing the shearable device further comprises increasing pressure in the casing string above the bottom hole assembly and moving coiled tubing down the casing string, the coiled tubing being connected to the bottom hole assembly.

17. The method of claim 6 further comprising selectively retaining the sleeve in the second position.

18. The method of claim 6, wherein positioning the bottom hole assembly and connecting the portion of the bottom hole assembly to the first sleeve comprises moving coiled tubing in only an upward direction.

19. The method of claim 6, wherein connecting a portion of the bottom hole assembly to the first sleeve further comprises pumping fluid down coiled tubing to actuate an anchor.

20. A wellbore completion system comprising:

a housing operatively connected between two casing tubulars of a casing string, the housing including at least one port through the housing;

a sleeve connected to the housing, the sleeve being movable between a first position and a second position, wherein in the first position the sleeve prevents fluid communication through the port of the housing and, wherein the sleeve is moved downward from the first position to the second position;

a bottom hole assembly having a packing element and an anchor, the anchor being adapted to selectively connect the bottom hole assembly to the sleeve and the packing element being adapted to provide a seal between the bottom hole assembly and the sleeve, wherein the bottom hole assembly is adapted to move the sleeve downward from the first position to the second position upon application of a pressure differential across the seal between the bottom hole assembly and the sleeve;

a second housing operatively connected between two casing tubulars of the casing string, the second housing including at least one port through the second housing; and a sleeve connected to the second housing movable between a first position and a second position, wherein in the first position the sleeve prevents fluid communication through the port of the second housing.

* * * * *